US010960517B2

(12) United States Patent
Hanlon et al.

(10) Patent No.: US 10,960,517 B2
(45) Date of Patent: Mar. 30, 2021

(54) ADJUSTABLE QUICK VISE

(71) Applicant: JS Products, Inc., Las Vegas, NV (US)

(72) Inventors: Jared Hanlon, Las Vegas, NV (US); Li Qiang Yuan, Qingdao (CN)

(73) Assignee: JS Products, Inc., Las Vegas, NV (US)

( * ) Notice: Subject to any disclaimer, the term of this patent is extended or adjusted under 35 U.S.C. 154(b) by 192 days.

(21) Appl. No.: 15/204,983

(22) Filed: Jul. 7, 2016

(65) Prior Publication Data

US 2017/0008155 A1 Jan. 12, 2017

Related U.S. Application Data

(60) Provisional application No. 62/189,361, filed on Jul. 7, 2015.

(51) Int. Cl.

| | |
|---|---|
| ***B25B 1/24*** | (2006.01) |
| ***B25B 1/12*** | (2006.01) |
| ***B25B 1/10*** | (2006.01) |
| ***B25B 1/22*** | (2006.01) |

(52) U.S. Cl.

CPC ..... *B25B 1/2484* (2013.01); *B25B 1/103* (2013.01); *B25B 1/12* (2013.01); *B25B 1/22* (2013.01); *B25B 1/2457* (2013.01); *B25B 1/2489* (2013.01)

(58) Field of Classification Search

CPC .... B25B 1/00; B25B 1/02; B25B 1/06; B25B 1/10; B25B 1/103; B25B 1/22; B25B 1/2405; B25B 1/241; B25B 1/52484; B25B 1/2489; B25B 5/00; B25B 5/006; B25B 5/02; B25B 5/06; B25B 5/10; B25B 5/102; B25B 5/109; B25B 5/16; B25B 5/166

See application file for complete search history.

(56) References Cited

U.S. PATENT DOCUMENTS 1,333,432 A * 3/1920 Maier ..... B23Q 1/545 269/63
1,391,913 A * 9/1921 Smith ..... B25B 1/125 269/177
1,392,130 A * 9/1921 Engstrom ..... B23Q 1/5406 269/71

(Continued)

FOREIGN PATENT DOCUMENTS

CN 2625112 7/2004
CN 103372819 10/2013

(Continued)

OTHER PUBLICATIONS

Office Action and English Translation for China Patent Application No. 201680051266.6, dated May 22, 2019, 28 pages.

*Primary Examiner* — Tyrone V Hall, Jr.
(74) *Attorney, Agent, or Firm* — Weide & Miller, Ltd.

(57) ABSTRACT

An embodiment of a vise may include a clamping structure having a first clamping jaw, a second clamping jaw positioned relative to the first clamping jaw, and a quick adjust jaw guide to maintain the first clamping jaw relative to the second clamping jaw. The quick adjust jaw guide may include a driving element to apply a force to move the first clamping jaw relative to the second clamping jaw, wherein the driving element comprises a release structure to release the applied force to facilitate rapid adjustment of the first clamping jaw relative to the second clamping jaw.

22 Claims, 11 Drawing Sheets

(56) References Cited

U.S. PATENT DOCUMENTS 1,511,298 A * 10/1924 Petzold ..... B25B 1/22 269/59
1,753,924 A * 4/1930 Gordon ..... B25B 1/125 269/157
2,260,995 A * 10/1941 Kruczek ..... B23Q 1/545 403/90
2,703,028 A * 3/1955 Goodwill ..... B25B 1/2452 269/71
2,734,409 A * 2/1956 Schum et al. ..... B25B 1/103 269/78
3,556,506 A * 1/1971 Welker ..... B25B 1/22 269/72
3,815,892 A * 6/1974 Tulk ..... B23Q 1/545 269/75
4,243,212 A * 1/1981 Bunyea ..... B25B 1/22 269/75
4,257,584 A * 3/1981 Sterling ..... B25B 5/102 269/167
5,417,409 A * 5/1995 Reddell ..... B25B 1/125 269/100
6,595,508 B2 * 7/2003 Duncan ..... B25B 1/103 269/242
8,540,225 B2 9/2013 Ehnstrom
2003/0071405 A1 * 4/2003 Miksovsky ..... B25B 11/007 269/95
2015/0239098 A1 * 8/2015 Vincent ..... B25B 5/006 182/129

FOREIGN PATENT DOCUMENTS

CN 103817611 5/2014
CN 203579440 5/2014
CN 203636663 6/2014
CN 203650011 6/2014
CN 203712532 7/2014
WO 2013024498 2/2013

* cited by examiner

ADJUSTABLE QUICK VISE

CROSS-REFERENCE TO RELATED APPLICATIONS

This application claims the priority benefit under 35 U.S.C. § 119(e) of U.S. provisional patent application Ser. No. 62/189,361, filed Jul. 7, 2015, which is hereby incorporated by reference.

BACKGROUND

Vises are useful tools for holding various work pieces while performing work operations on the work piece. A vise typically includes a first jaw and a second jaw that are configured to operate relative to each other. In particular, a force is typically applied between the first jaw and the second jaw, causing the jaws to supply a compression force to the work piece, thereby holding the work piece in place. Vises are useful for welding, sanding, drilling, sawing, and various other work functions.

It may be useful to mount a vise to a workbench. Mounting the vise prevents movement of the vise and the work piece, and the workbench provides a suitable surface at a suitable height for performing the various work functions. Typically, a vise is simply bolted to the work bench, and therefore, is not adjustable. Rather, the vise sits in a static position, relative to the work bench. This may not be suitable for certain work functions that require manipulation of the orientation of the work piece.

SUMMARY

Embodiments of a vise are described. In an embodiment, a vise may include a clamping structure and an adjustable base configured to mount the clamping structure to a work surface. In an embodiment the clamping structure may include a first clamping jaw, a second clamping jaw positioned relative to the first clamping jaw, and a quick adjust guide to maintain the first clamping jaw relative to the second clamping jaw. In an embodiment, the adjustable base may include a surface mounting structure configured to mount to a work surface, the surface mounting structure comprising positional adjustments to facilitate a positional adjustment of the vise relative to the work surface. Additionally, the adjustable base may include a vise mounting structure to interface with the surface mounting structure to secure the vise relative to the work surface, wherein the vise mounting structure engages with the positional adjustments of the surface mounting structure to facilitate adjustment of the position of the vise relative to the work surface. The adjustable base may also include an adjustment structure to facilitate rapid adjustment of the vise mounting structure relative to the surface mounting structure and to facilitate detachment of the vise structure from the surface mounting structure.

In an embodiment, the vise also includes a driving element to apply a force to move the first clamping jaw relative to the second clamping jaw, wherein the driving element comprises a release structure to release the applied force to facilitate rapid adjustment of the first clamping jaw relative to the second clamping jaw. Additionally, the vise may include a force structure coupled to the driving element to facilitate a user application of force to the driving element. In such an embodiment, the user application of force operates a ratcheting mechanism to move the first clamping jaw relative to the second clamping jaw.

In an embodiment, the vise includes at least one guide rail to maintain an alignment between the first clamping jaw and the second clamping jaw. In such an embodiment, the at least one guide rail comprises a telescoping guide rail. Additionally, at least one of the first clamping jaw and the second clamping jaw is configured to receive a jaw pad, in some embodiments.

Another embodiment of a vise may include a clamping structure having a first clamping jaw, a second clamping jaw positioned relative to the first clamping jaw, and a quick adjust jaw guide to maintain the first clamping jaw relative to the second clamping jaw. The quick adjust jaw guide may include a driving element to apply a force to move the first clamping jaw relative to the second clamping jaw, wherein the driving element comprises a release structure to release the applied force to facilitate rapid adjustment of the first clamping jaw relative to the second clamping jaw.

In a further embodiment, the vise may include a surface mounting structure configured to mount to a work surface, the surface mounting structure comprising positional adjustments to facilitate a positional adjustment of the vise relative to the work surface. Additionally, the vise may include a vise mounting structure to interface with the surface mounting structure to secure the vise relative to the work surface, wherein the vise mounting structure engages with the positional adjustments of the surface mounting structure to facilitate adjustment of the position of the vise relative to the work surface. In a further embodiment, the vise may include an adjustment structure to facilitate rapid adjustment of the vise mounting structure relative to the surface mounting structure and to facilitate detachment of the vise structure from the surface mounting structure. Also, the vise may include a force structure coupled to the driving element to facilitate a user application of force to the driving element, wherein the user application of force operates a ratcheting mechanism to move the first clamping jaw relative to the second clamping jaw.

In an embodiment, the vise may include at least one guide rail to maintain an alignment between the first clamping jaw and the second clamping jaw. In such an embodiment, the at least one guide rail comprises a telescoping guide rail. Also, at least one of the first clamping jaw and the second clamping jaw may be configured to receive a jaw pad.

Another embodiment of a vise may include a clamping structure having a first clamping jaw, a second clamping jaw positioned relative to the first clamping jaw, and a quick adjust jaw guide to maintain the first clamping jaw relative to the second clamping jaw. In an embodiment, the quick adjust jaw guide includes at least one telescoping guide rail to maintain an alignment between the first clamping jaw and the second clamping jaw.

In an embodiment, the vise may also include an adjustable base configured to mount the clamping structure to a work surface. In such an embodiment, the adjustable base further comprises a surface mounting structure configured to mount to a work surface, the surface mounting structure comprising positional adjustments to facilitate a positional adjustment of the vise relative to the work surface. Additionally, the adjustable base may include a vise mounting structure to interface with the surface mounting structure to secure the vise relative to the work surface. In such embodiments, the vise mounting structure engages with the positional adjustments of the surface mounting structure to facilitate adjustment of the position of the vise relative to the work surface.

In another embodiment, the vise includes an adjustment structure to facilitate rapid adjustment of the vise mounting structure relative to the surface mounting structure and to facilitate detachment of the vise structure from the surface mounting structure. Also, the vise may include a driving element to apply a force to move the first clamping jaw relative to the second clamping jaw, wherein the driving element comprises a release structure to release the applied force to facilitate rapid adjustment of the first clamping jaw relative to the second clamping jaw. The vise may further include a force structure coupled to the driving element to facilitate a user application of force to the driving element. In such an embodiment, the user application of force operates a ratcheting mechanism to move the first clamping jaw relative to the second clamping jaw. In various embodiments, at least one of the first clamping jaw and the second clamping jaw is configured to receive a jaw pad.

Embodiments of a jaw pad are also described. In an embodiment, a jaw pad may include a first surface configured to engage a work piece, and a receiver configured to receive at least one of a first clamping jaw and a second clamping jaw of a vise.

The receiver ray include a recess configured to receive the at least one of the first clamping jaw and the second clamping jaw of the vise. In a further embodiment, the receiver further comprises a slot for receiving and retaining a portion of the at least one of the first clamping jaw and the second clamping jaw.

In an embodiment, the first surface comprises a concave profile for receiving a non-planar work piece. Furthermore, the first surface may include a grip feature. In an embodiment, the grip feature comprises a slot. In another embodiment, the grip feature comprises a tooth.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Aspects of the present disclosure may be embodied as an adjustable quick vise. Embodiments of the present disclosure provide a vise having a first clamping jaw and a second clamping jaw moved by a driving element. The driving element may be releasably coupled to one or both of the first and second clamping jaws. The vise may be mounted to a work surface at a base. The base may be adjustable to change the orientation of the vise relative to the work surface.

In the following description, numerous details are set forth. It will be apparent, however, to one skilled in the art, that the present invention may be practiced without these specific details. In some instances, well-known structures and devices are shown in block diagram form, rather than in detail, in order to avoid obscuring the present invention.

Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the disclosure may be combined in any suitable manner in one or more embodiments. In the following description, numerous specific details are provided to give a thorough understanding of embodiments of the disclosure. However, the disclosure may be practiced without one or more of the specific details, or with other methods, components, materials, and so forth. In other instances, well-known structures, materials, or operations are not shown or described in detail to avoid obscuring aspects of the disclosure.

The description of elements in each figure may refer to elements of subsequent or preceding figures. Like numbers refer to like elements in all figures, including alternate embodiments of like elements.

Figure 1:
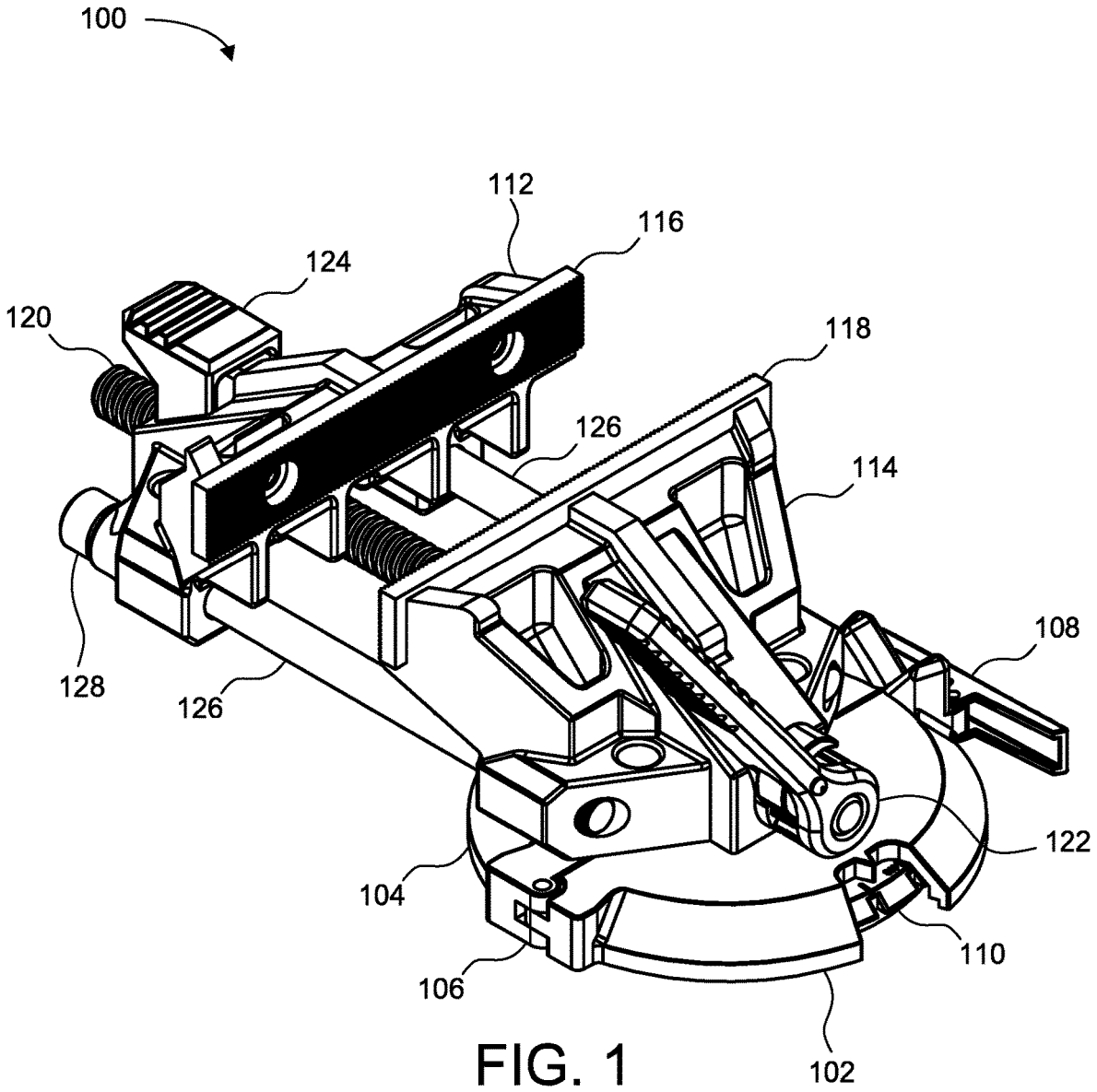
FIG. 1 illustrates one embodiment of an adjustable quick vise.

FIG. 1 illustrates one embodiment of an adjustable quick vise 100. The quick vise 100 includes an adjustable base. In the illustrated embodiment, the adjustable base includes a first base portion 102 and a second base portion 104, a base hinge 106, a base closure 108, and a surface mounting structure 110. In other embodiments, the adjustable base may include fewer or more components to achieve more or less functionality than that discussed with relation to the various embodiments described below.

In the illustrated embodiment, the first base portion 102 connects to the second base portion 104 at the base hinge 106 and releasably connects at the base closure 108. In some embodiments, the first base portion 102 interfaces with the surface mounting structure 110. The first base portion 102 forms a vise mounting structure as it facilitates connection of the vise 100 to a work surface (not shown) via the surface mounting structure 110. The first base structure 102 interfaces with the surface mounting structure 110 by coupling with the second base portion 104.

In the illustrated embodiment, the first base portion 102 is connected to the second base portion 104 by the base hinge 106. The base hinge 106 is shown as a pinned connection but may also include other types of hinge connections. In the illustrated embodiment, the hinge 106 allows for the first and second base portions 102 and 104 to connect in a clam-shell fashion with the base closure 108 connecting the first and second base portions 102 and 104. The base closure 108 may act as an adjustment structure to facilitate a relatively rapid adjustment of the vise 100 at the interface with the surface mounting structure 110. In some embodiments, the first and second base portions 102 and 104 interface with the surface mounting structure 110 by enclosing the surface mounting structure 110 when the first and second base portions 102 and 104 are in the closed position.

In some embodiments, the first and second base portions 102 and 104 may be adjusted relative to the surface mounting structure 110. This may be achieved by releasing the base closure 108 to operate the base hinge 106 and separate the first and second base portions 102 and 104 to alleviate the locking forces applied to the surface mounting structure 110. This may disengage the first and second base portions 102 and 104 from the surface mounting structure 110 such that the first and second base portions 102 and 104 and remainder of the vise 100 are free to move relative to the surface mounting structure 110 or free to be completely removed from the surface mounting structure 110.

In some embodiments, one or each of the surface mounting structure 110, the first base portion 102, and the second base portion 104 includes a positional adjustment to provide indicators, increments, or measures of the first and second base portions 102 and 104 relative to the surface mounting structure 110. In some embodiments, the positional adjustment may include a physical structure to provide a tactile feedback to give a user positive indication of a certain adjustment, movement, or position. The positional adjustment may also have visual indicators such as markings, numbers, bars, or other indicators to communicate a relative position, adjustment, or setting.

In some embodiments, the first and second base portions 102 and 104 may be replaced by a single unified structure (described in greater detail below with relation to FIG. 4). In this embodiment, the unified structure interfaces with the surface mounting structure 110 and is adjustable via a tab, lever, button, slide, lock, or other mechanism to release the unified structure with relation to the surface mounting structure 110. In some embodiments, the same or another mechanism may release the unified structure from the surface mounting structure 110 entirely. In this way, the vise 100 may be separated from the surface mounting structure 110 and thus separated from the work surface on which the surface mounting structure 110 may be mounted.

The illustrated embodiment of the vise 100 includes the first clamping jaw 112 and the second clamping jaw 114. The first and second clamping jaws 112 and 114 are oriented to open and close relative to one another. The first and second clamping jaws 112 and 114 may have a structural arrangement to improve strength, reduce weight, provide aesthetic appeal, and/or provide storage. In some embodiments, the first and second clamping jaws 112 and 114 move along a linear path relative to one another. In other embodiments, the first and second clamping jaws 112 and 114 may be moved or be adjustable outside of the linear path. In some embodiments, the first and second clamping jaws 112 and 114 include clamping surfaces (shown as first clamping surface 116 and second clamping surface 118). In the illustrated embodiment, the first and second clamping surfaces 116 and 118 are aligned on parallel planes such that closure of the vise 100 will bring the first and second clamping surfaces 118 and 118 into flush contact with one another. In other embodiments, one or both of the first and second clamping surfaces 116 and 118 may be adjusted or moved to translate along planes that are non-parallel. For example, the first clamping surface 116 may be adjusted to be oriented at some angle relative to the second clamping surface 118 such that closure of the first and second clamping jaws 112 and 114 would cause the first and second clamping surfaces 116 and 118 to contact one another on a single side or point without being flush to one another. In this manner a work piece that is irregular in size (for example, tapered) may be easily gripped within the vise 100. This adjustment may be facilitated by a ball-and-socket joint connecting one or both of the first clamping surface 116 to the first clamping jaw 112 and the second clamping surface 118 to the second clamping jaw 114. Other pinned joints, sliders, manual adjustment joints, locking or free-moving joints may be incorporated.

In some embodiments, the first and second clamping jaws 112 and 114 are moved relative to one another by a force applied through a driving element 120. In the illustrated embodiment, the driving element 120 is a threaded structure such as an acme screw or worm. In this manner, as the driving element is turned, one or both of the first and second clamping jaws 112 and 114 are drawn towards or driven away from the other. The driving element 120 may include other structures or mechanisms to apply a force to move the first and second clamping jaws 112 and 114 relative to the other. For example, the driving element 120 may include a hydraulic or mechanical piston, a rack and pinion, or other driving system.

In the illustrated embodiment, the driving element 120 is connected to the force structure 122. The force structure 122 may be a handle, knob, key, lever, or other structure to which a user, machine, or tool may apply a force to operate the vise 100. In the illustrated embodiment, the force structure 122 is a handle formed to accommodate a force input from a user's hand. The illustrated embodiment of the force structure 122 has a somewhat flattened design similar to a paddle. Other geometries and shapes may be incorporated to provide different strength, weight, cost, leverage, force translation, ergonomics, or other characteristics.

In some embodiments, the force structure 122 is fixedly attached to the driving element 120. However, in the illustrated embodiment, the force structure 122 is coupled to the driving element 120 with a ratcheting mechanism to allow the user to ratchet the force structure 122 to apply force to the driving element 120 and thereby move the jaws 112 and 114 of the vise 100. In some embodiments, the ratcheting structure may be a toothed ratchet which interfaces with a pawl and catch. In another embodiment, the ratchet may be a toothless or friction ratchet. It may also be a compression ratchet. Other forms of ratchets may also be used. Additionally, other mechanisms such as gearing to step up or step down the torque or displacement may also be incorporated. In some embodiments, mechanisms such as a ratchet or gearing may be incorporated into the force structure 122, the driving element 120, or separately as an interface between the two.

In the illustrated embodiment, the first clamping jaw 112 is secured to the driving element 120 by the release structure 124. In the depicted embodiment, the release structure 124 is mounted on the first clamping jaw 112 and interfaces with the driving element 120. The release structure 124 may interface with the driving element 120 by meshing a corresponding threaded portion of the release structure 124 into the threads of the driving element 120. The release structure 124 may also include a frictional component to translate the rotational movement of the illustrated driving element 120 to translational motion of the first clamping jaw 112. Other embodiments of the release structure 124 may include other interfaces. For example, the release structure 124 may include one or more tracking pins or teeth to mesh with the driving element, a wheel or bearing to roll along the surface features of the driving element 120, or one or more splines to track the movement of the driving element 120. These interfaces may be situated on all or part of the internal structure of the release structure 124. For example, the release structure 124 may only interface the driving element 120 on a single portion of the driving element 120 such as the lower portion. It may interface the driving element 120 at multiple positions on the driving element 120 similar to a drill chuck or collet. Other interfacing schemes may be incorporated.

In the illustrated embodiment, the release structure 124 allows the user to release the first clamping jaw 112 from the driving element 120. In some embodiments, the release structure 124 disengages from the driving element 120 in response to a user input at the release structure 124. For example, in different embodiments, the user may apply a downward, upward, or horizontal force at the release structure 124 to disengage the release structure 124 from the driving element 120.

In another embodiment, the release structure 124 may release the driving element 120 in response to an input at the driving element 120. For example, the release structure 124 may disengage from the driving element 120 in response to a user locking and reversing the input at the force structure 122. Other inputs or triggers may be used to engage and disengage the release structure 124 from the driving element 120. For example, the release structure 124 may operate only when a second structure (not shown) is also acted upon by the user.

In another embodiment, the release structure 124 may be incorporated in the force structure 122 such that the force structure 122 may be released from the driving element 120 to quickly adjust the relative position of the jaws 112 and 114. Other embodiments may include other arrangements for engaging and disengaging with the driving element 120 to adjust the relative position of the first and second clamping jaws 112 and 114.

Disengaging the release structure 124 from the driving element 120 will allow the first clamping jaw 112 to move freely relative the driving element 120 and the second clamping jaw 114. This allows the user to quickly adjust the relative distance, to either close the gap between the jaws 112 and 114 or increase the gap, in order accommodate insertion, removal, repositioning, or adjustment of a work piece.

In the illustrated embodiment, the first and second clamping jaws 112 and 114 are maintained in alignment by guide rails 126. The guide rails 126 allow for relative movement of the first and second clamping jaws 112 and 114 along a linear path. The guide rails 126 may include stops 128 to prevent the first or second clamping jaw 112 or 114 from being runout off the driving element 120 and guide rails 126. In some embodiments, the stops 128 may be removably coupled to the guide rails 126. For example, the stops 128 may be threaded or clipped onto the guide rails 126 such that they may be removed for disassembly, maintenance, or repairs on the vise 100. In other embodiments, the stops 128 are a unified portion of the guide rails 126 or otherwise permanently affixed to prevent accidental or intentional removal.

In some cases, the rails 126 are a low friction material. In other embodiments, the rails 126 may have a lubricant or lubricant facilitator applied or embedded. One or both of the first and second clamping jaws 112 and 114 may also include friction reducing mechanisms such as bearings, slides, or other low-friction surfaces at the points at which they contact the rails 126. The rails 126 may be smooth, as shown in FIG. 1 or they may have a surface structure to facilitate enhanced tracking of the jaws 112 and 114 on the rails 126. For example, the rails 126 may include a slot or groove which accepts a fin or tooth on the jaw 112. Other structures or surface features may be incorporated. In some embodiments, the vise 100 includes fewer or more than the illustrated pair of guide rails 126.

Figure 2A:
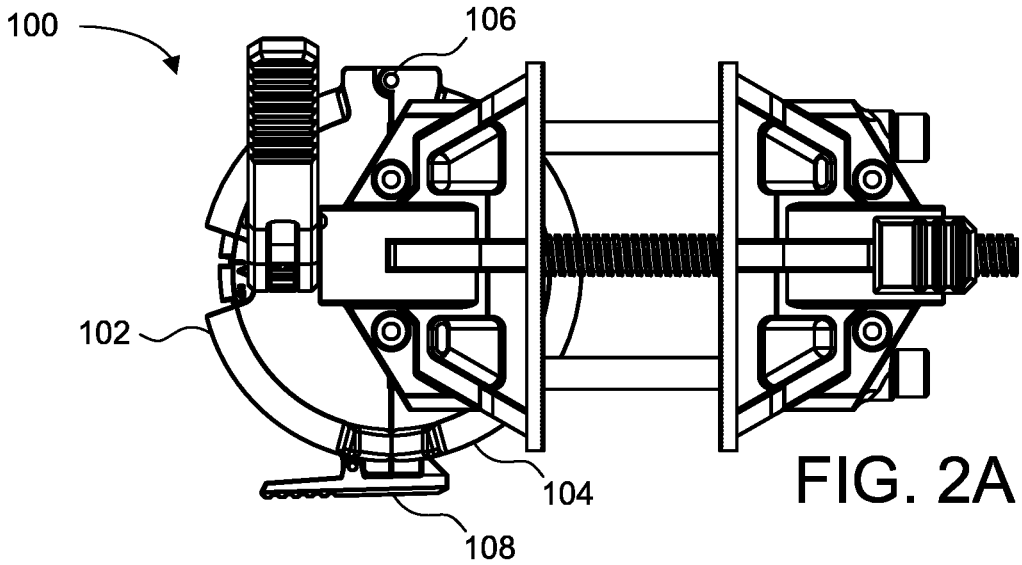
FIG. 2A is a perspective view illustrating one embodiment of the adjustable quick vise.
Figure 2B:
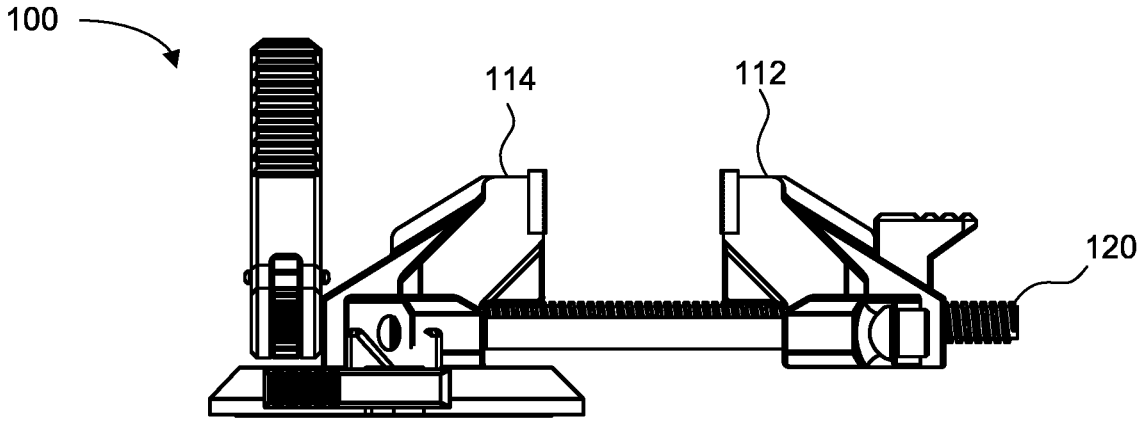
FIG. 2B is a perspective view illustrating one embodiment of the adjustable quick vise.
Figure 2C:
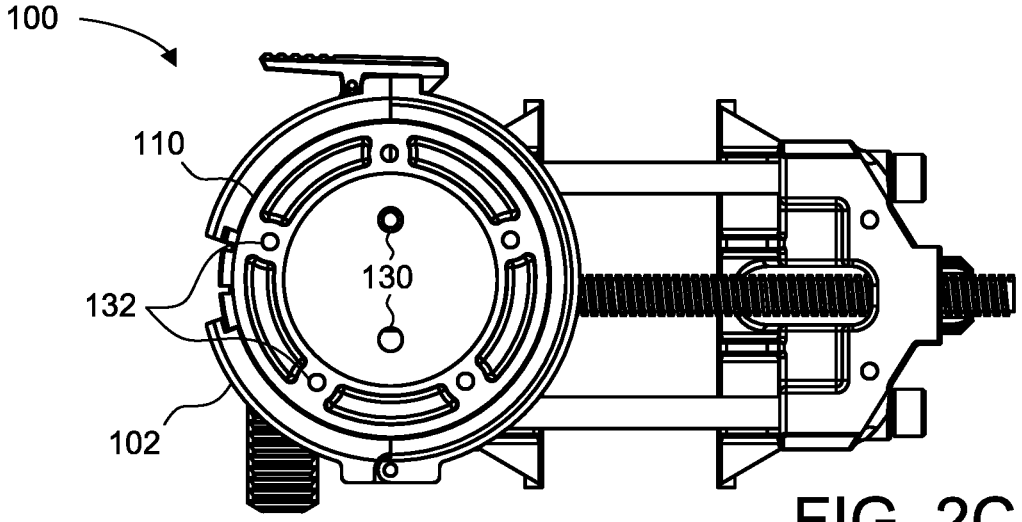
FIG. 2C is a perspective view illustrating one embodiment of the adjustable quick vise.

FIGS. 2A, 2B, and 2C are perspective views illustrating one embodiment of the adjustable quick vise 100 in accordance with embodiments of the disclosure. FIG. 2A depicts an overhead view of the vise 100. In this view, the orientation of the base closure 108 with respect to the first and second base portions 102 and 104 may be clearer. Additionally, the pinned hinge 106 can be seen opposite the base closure 108. As described above with reference to FIG. 1, the first and second base portions 102 and 104 may be maintained in a closed position by the base closure 108 and the hinge 106. Other embodiments may include a second base closure (not shown) in place of the hinge 106. The two base closures may be of similar or different structure and operation.

FIG. 2B illustrates a side view of the vise 100. In this view, the alignment of the first and second clamping jaws 112 and 114 may be observed. In the illustrated embodiment, the first and second clamping jaws 112 and 114 are oriented to travel along a purely horizontal path which may be parallel to the work surface (not shown) on which the vise 100 is mounted. As described above, in some embodiments, the orientation and travel of the first and second clamping jaws 112 and 114 may be non-horizontal. For example, the vise 100 may include a tilting structure (not shown) to allow the vise 100 to translate the jaws 112 and 114 along paths that are not parallel to the work surface. Some embodiments may facilitate rotation of the vise 100 such that the jaws 112 and 114 are rotated 90° with respect to the axis of the driving element 120. This would allow the vise 100 to clamp a work piece from the side instead of a lower portion. Other embodiments may include other orientations or similar adjustments to the vise 100.

FIG. 2C illustrates a bottom view of one embodiment of the vise 100. In the depicted embodiment, some of the mounting features of the vise 100 are shown. The first base portion 102 includes attachment features 130 to facilitate attachment of the first base portion 102 to the body of the vise 100. In some embodiments, the attachment features 130 are threaded or non-threaded holes aligned with threaded or non-threaded holes in the underside of the vise 100 to facilitate the use of screws, bolts, nails, pins, adhesive, or other fasteners. In another embodiment, the attachment features 130 are open to receive a portion of the vise 100 through the holes to secure the first base portion 102 in place. Alternatively, the attachment features 130 may extend into the vise 100 to secure the first base portion 102.

The surface mounting structure 110 includes mounting features 132 to facilitate mounting the surface mounting structure 110 to a work surface. Similar to the description of the attachment features 130, the mounting features 132 may accommodate screws, bolts, or other fasteners. The mounting features 132 may apply suction, friction, or other forces to the work surface to secure the surface mounting structure 110. The mounting features 132 may facilitate permanent or removable installation of the surface mounting structure 110 to the work surface. Other embodiments may include additional features for securing the surface mounting structure 110 to the work surface.

Figure 3:
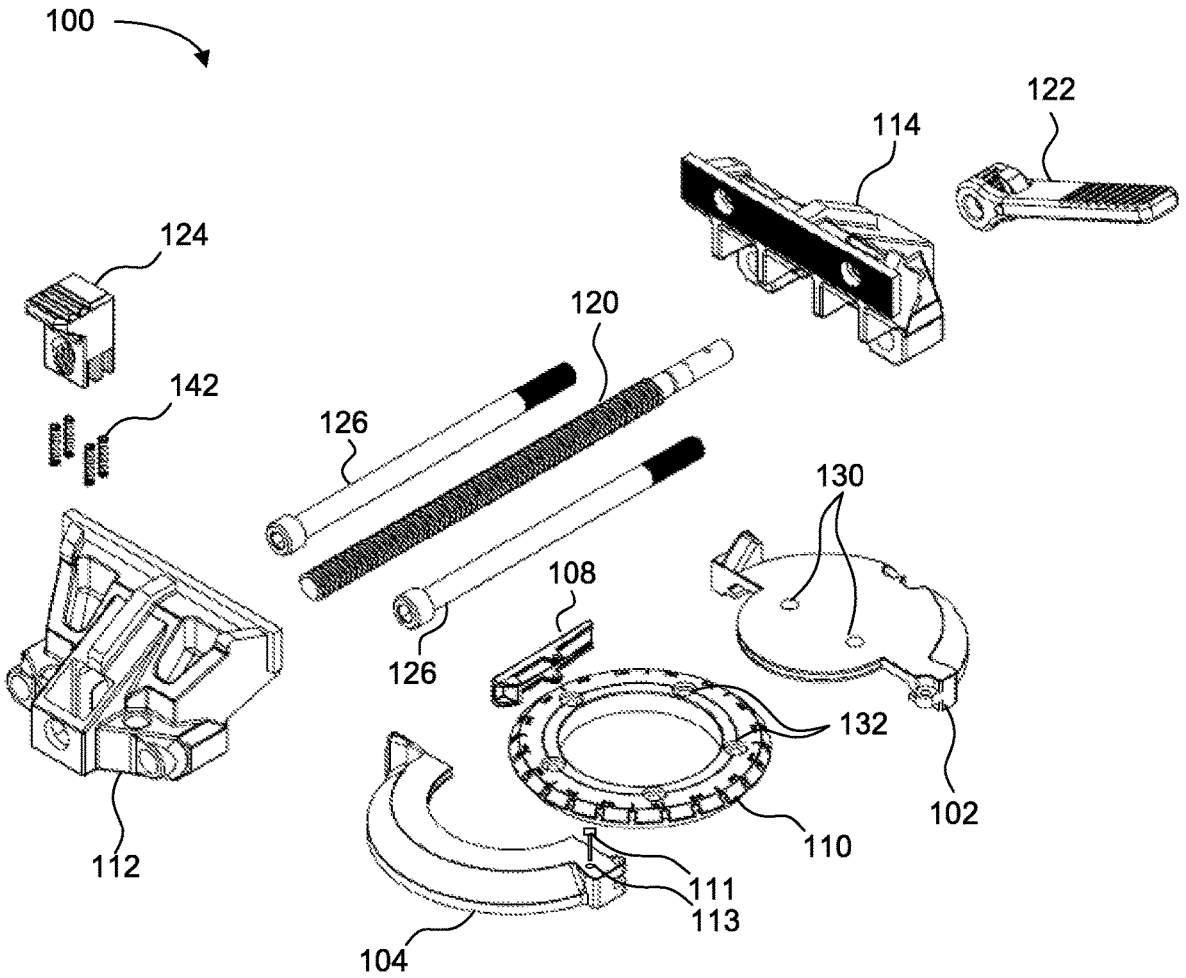
FIG. 3 is an exploded view illustrating one embodiment of the adjustable quick vise.

FIG. 3 is an exploded view illustrating one embodiment of the adjustable quick vise 100 in accordance with embodiments of the disclosure. In the illustrated view, the individual parts of the depicted embodiment are shown in a separated arrangement for simplicity and clarity. For example, as one aspect of the depicted view, it can be seen that this embodiment of the vise 100 includes threaded portions on the end of the guide rails 126. This allows the guide rails 126 to be inserted through the first clamping jaw 112 and thread into the second clamping jaw 114. In this manner, the first clamping jaw 112 is moveably secured on the rails 126 and aligned with the second clamping jaw 114.

In the illustrated embodiment, the driving element 120 is inserted through the second clamping jaw 114 and interfaces with the force structure 122. The interface between the force structure 122 and the driving element 120 may be a pinned, threaded, welded, or other connection. The force structure 122 then facilitates a ratcheting, fixed, or other input to the driving element 120. The driving element 120 is also inserted into the first clamping jaw 112 and interfaces with the release structure 124. As described above, different embodiments of the release structure 124 may interface with the driving element 120 in different manners. The illustrated embodiment of the release structure 124 includes one or more springs 142 to apply force to the release structure 124. The force applied by the springs 142 to the release structure 124 may force the release structure 124 to interface with the driving element 120. If a user presses on the release structure 124 with sufficient force to compress the springs 142, the release structure 124 may be displaced sufficiently to disengage the release structure 124 from the driving element 120. This may allow the first clamping jaw 112 to move freely along the driving element 120 and guide rails 126.

The illustrated embodiment also depicts the relative orientation of the first and second base portions 102 and 104 with the base closure 108 and the surface mounting structure 110. The position of the attachment features 130 of the first base portion 102 and the mounting features 132 of the surface mounting structure 110 may also be more easily understood in the depicted view. In alternate embodiments, the base portion 104 may include a locking pin 111 that engages an opening 113 in the base portion 104. The locking pin 111 is configured to pass through the opening and engage a slot in the surface mounting structure 110, thereby rotationally locking the base portions 102, 104 with the surface mounting structure 110. In an embodiment, the locking pin 111 may be a detent pin, a screw-threaded bolt, a t-handle, and the like. Beneficially, this allows the vise to be rotated to any position and then locked in that position.

Figure 4:
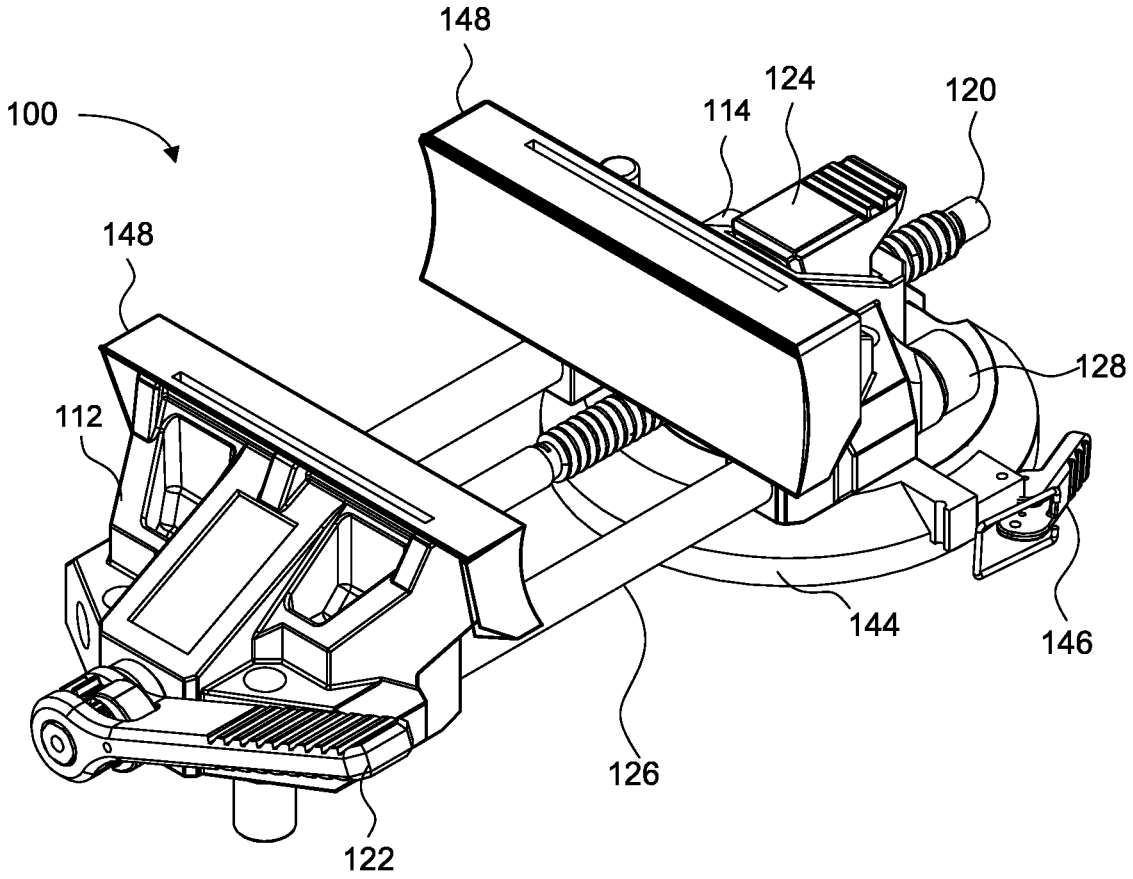
FIG. 4 illustrates another embodiment of an adjustable quick vise.

FIG. 4 illustrates another embodiment of an adjustable quick vise 100 in accordance with embodiments of the present disclosure. Some aspects and elements of the depicted embodiment of the vise 100 are similar to those of embodiments described above. However, in the illustrated embodiment, the surface mounting structure 110 is replaced with the quick change base 144. The quick change base 144 is similar in function and description to the surface mounting structure 110 described above and illustrated in preceding figures but includes some functional and aesthetic differences. In particular, the quick change base 144 is modified to interface directly with the second clamping jaw 114. The quick change base 144 also includes a base release 146. The base release 146 facilitates a user input to adjust the relative orientation of the vise 100 or, in some embodiments, removal of the vise 100 from the quick change base 144 itself or from the work surface. In the depicted embodiment, the base release 146 is a tab. In other embodiments, the base release 146 may be a lever, button, switch, toggle, or other user or tool interface.

The depicted embodiment also includes an alternative design for the release structure 124. In this embodiment, the release structure 124 is more integrated into the body of the second clamping jaw 114. This may improve durability and functional consistency. It may also improve resistance to contaminant and particulate intrusion into the release structure 124.

The illustrated embodiment also includes jaw pads 148. In some embodiments, the jaw pads 148 are permanently applied to the clamping surfaces 116 and 118 of FIG. 1. In other embodiments, the jaw pads 148 are removable. The jaw pads 148 may be made of various materials to provide differences in grip and gentleness on clamped work pieces. The jaw pads 148 may also have specific geometries or designs as described below with reference to FIGS. 5A, 5B, 5C, and 5D. Other embodiments may include fewer or more components of similar or modified size, shape, and function.

Figure 5A:
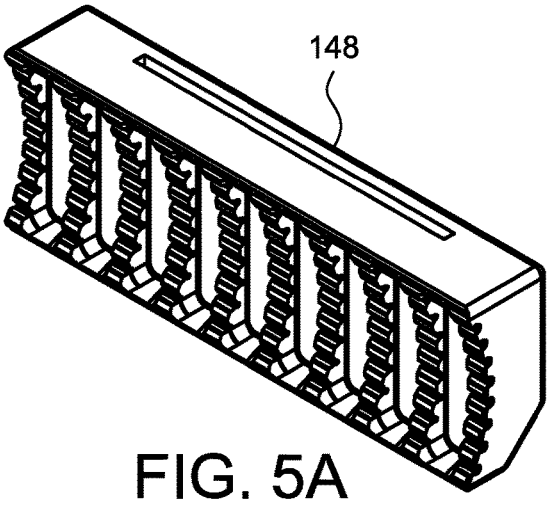
FIG. 5A illustrates an embodiment of clamping jaw attachments.

FIGS. 5A, 5B, 5C, and 5D illustrate various embodiments of clamping jaw attachments 148 in accordance with embodiments of the present disclosure. The illustrated embodiment of FIG. 5A depicts an embodiment of a clamping jaw attachment 148. The illustrated embodiment includes a face with one or more gripping features, such as slots or teeth. The slots may allow for grip in wet, dusty, particulate, greased, or other clamping situations. The teeth may provide additional grip or fit the surface of the work piece clamped. In the illustrated embodiment, the face of the clamping jaw attachment 148 is curved. This may accommodate a non-planar work piece or provide a particular clamping force at the work piece.

Figure 5B:
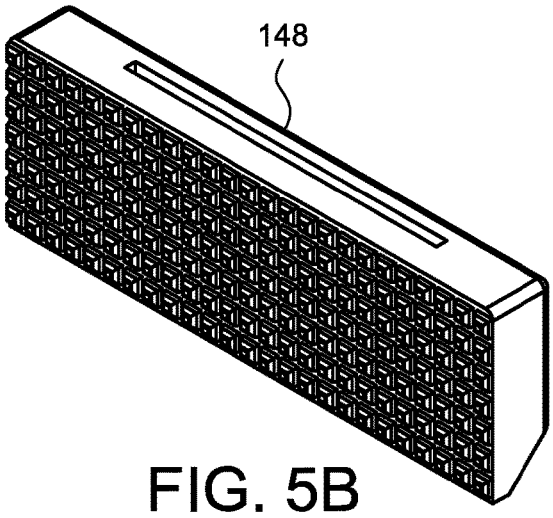
FIG. 5B illustrates an embodiment of clamping jaw attachments.
Figure 5C:
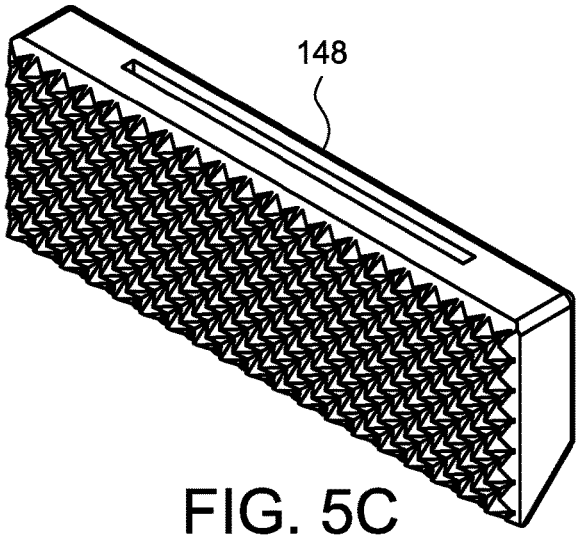
FIG. 5C illustrates an embodiment of clamping jaw attachments.
Figure 5D:
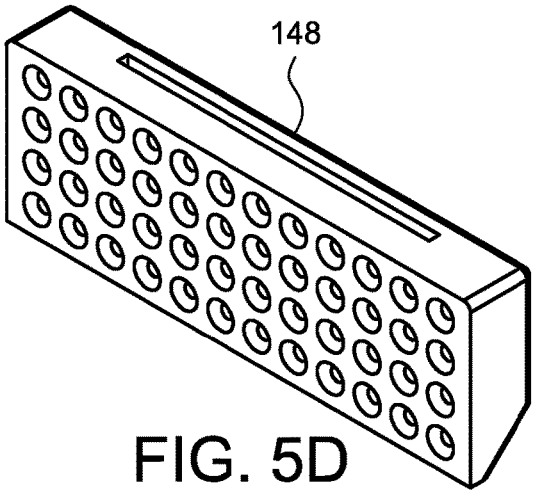
FIG. 5D illustrates an embodiment of clamping jaw attachments.

The illustrated embodiment of the clamping jaw attachment 148 of FIG. 5B includes a planar face with a waffle-style texturing. The illustrated embodiment of the clamping jaw attachment 148 of FIG. 5C also includes a planar face but integrates a pyramidal texture. The illustrated embodiment of the clamping jaw attachment 148 of FIG. 5D includes a planar face with circular cutaways.

Some embodiments of the clamping jaw attachments 148 may be made of a flexible material to provide a certain gripping functionality. Other embodiments may include rigid or semi-rigid materials. In some embodiments, the clamping jaw attachments 148 may include multiple materials to provide certain advantages. Embodiments of the clamping jaw attachments 148 may include numerous surface textures and geometries to interface with work pieces or provide other gripping and aesthetic functionality. Some embodiments may include structures or features to facilitate installation and removal of the clamping jaw attachments 148 onto and off of the clamping jaws 112 and 114. Other features may improve the security of the attachments 148 on the clamping jaws 112 and 114. Other embodiments may include fewer or more features to provide less or more functionality.

Figure 6A:
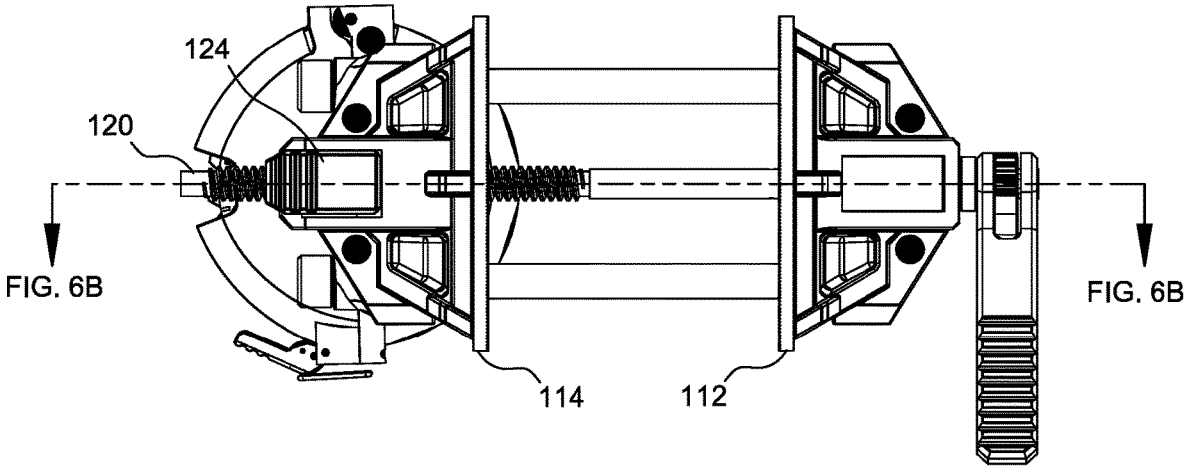
FIG. 6A is a top view diagram illustrating an embodiment of a release structure and clamping jaw.

FIG. 6A is a top view diagram illustrating one embodiment of a release structure 124. The release structure 124 may be configured to engage and release the driving element 120 as shown in FIG. 6B, which is a cross-section diagram taken along the axis shown in FIG. 6A.

Figure 6B:
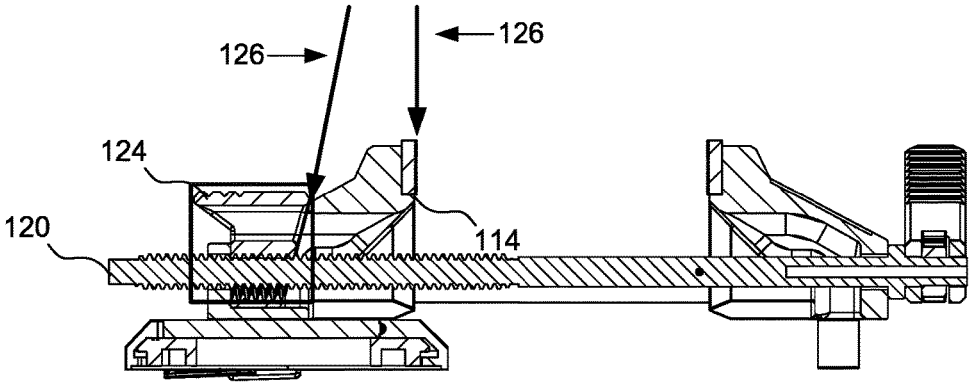
FIG. 6B is a schematic cross-sectional diagram illustrating one embodiment of a release structure and the clamping jaw.

FIG. 6B is a schematic cross-sectional diagram illustrating one embodiment of the release structure 124 and the clamping jaw 114. In one embodiment, the release structure 124 and the clamping jaw 114 may have parallel but non-orthogonal surfaces with respect to the driving element 120. In other words, the mating surfaces of the release structure 124 and the clamping jaw 114 may have an angle with respect to the driving element that is less than or greater than 90 degrees. This relationship is depicted in FIG. 6B by arrows 126. Selecting a non-orthogonal angle 126 beneficially prevents the release structure 124 from "slipping" when torque is applied by the driving element 120. With an orthogonal angle 126, as the driving element 120 applies a force on the release structure 124, the release structure 124 may have a tendency to "climb" or advance downward to the point that the release structure 124 releases and disengages from the driving element 120. Beneficially, a non-orthogonal angle prevents such "climbing." In one embodiment, the angle 126 is in the range of between about 10 and 40 degrees. In another embodiment, the angle 126 is in the range of between about 25 and 35 degrees.

Figure 6C:
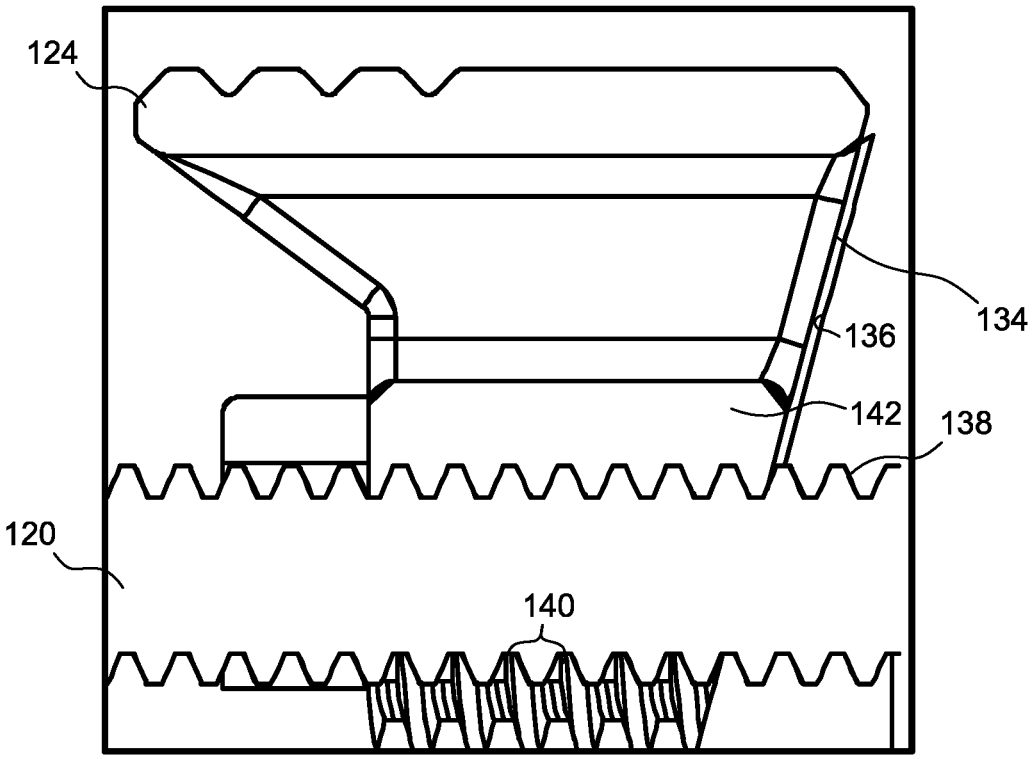
FIG. 6C is a detailed view diagram illustrating one embodiment of a release structure.

FIG. 6C illustrates a detailed view of the release structure 124. In an embodiment, the release structure 124 may include a first engagement surface 134 configured to engage a second engagement surface 136 of the second clamping jaw 114. Additionally, the release structure 124 may include a recess 142 configured to allow operation of the release structure 124 relative to the driving element 120. The release structure 124 may also include one or more engagement members 140 configured to engage the screw threads 138 of the driving element 120. Upon operation of the release structure 124, the engagement members 140 may disengage and re-engage with the screw threads 138 by sliding the engagement members 140 away from the screw threads 138 and causing the recess 142 to slide around the driving element 120.

Figure 7A:
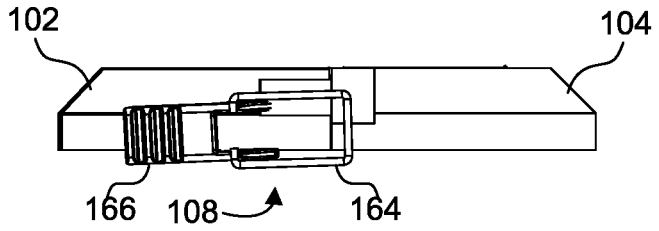
FIG. 7A is a side view diagram illustrating one embodiment of a mounting structure.

FIGS. 7A-7D illustrate various embodiments of the base. As illustrated in FIG. 7A, such an embodiment may include the first base portion 102 and the second base portion 104. Additionally, a base closure 108 may be included. In one embodiment, the base closure 108 may include a handle 166 and a latch 164. In a further embodiment, the handle 166 may operate the latch 164.

Figure 7B:
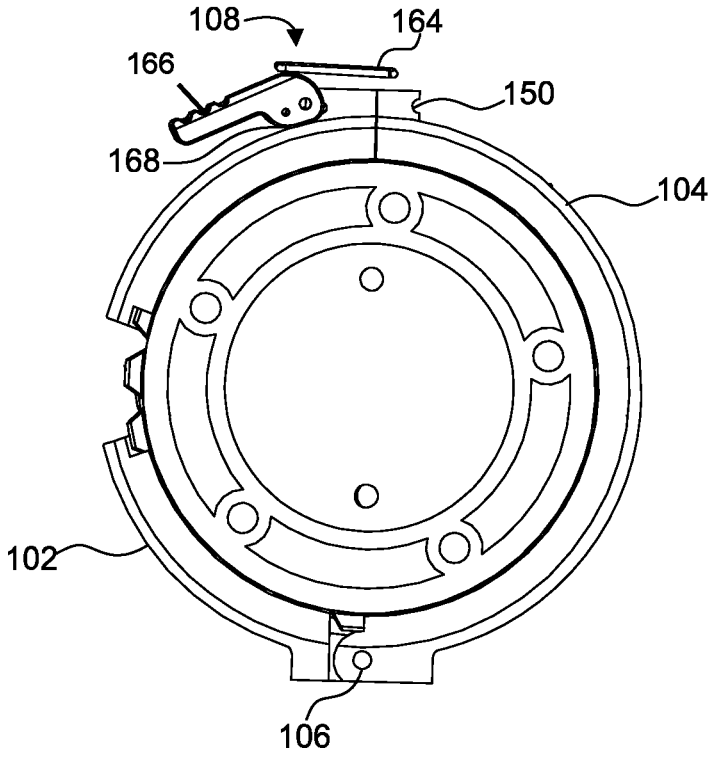
FIG. 7B is a bottom view diagram illustrating one embodiment of a mounting structure.
Figure 7C:
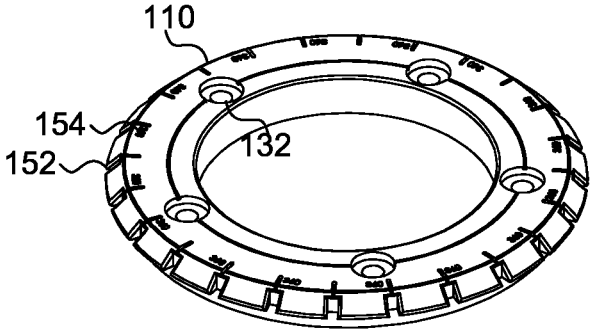
FIG. 7C is a perspective view diagram illustrating one embodiment of a portion of a mounting structure.

FIG. 7B illustrates a further embodiment of the base. In such an embodiment, the handle 166 may include a chamfered surface 168 which operates to slide across a surface of the first base portion 102. The chamfered surface 168 may provide a positive locking force between the latch 164 and the notch 150, when the latch 164 engages the notch 150 and the handle 166 is operated into a closed or locked position. Additionally, a pinned hinge 106 may be formed between the first base portion 102 and the second base portion 104, allowing the base to open and close around the surface mounting structure 110 illustrated in FIG. 7C.

In an embodiment the surface mounting structure 110 may include one or more mounting features 132, such as holes for receiving a screw, bolt, or other fasteners. Additionally, the surface mounting structure 110 may include a plurality of adjustment points 152. Adjustment points 152 may include recesses, slots, dimples, notches, or the like. In an embodiment, a mating adjustment point in the base closure (not shown) may engagement the adjustment points 152 to lock the base in a fixed position. One or more indicators 154 may be included to indicate an azimuthal position of the base.

Figure 7D:
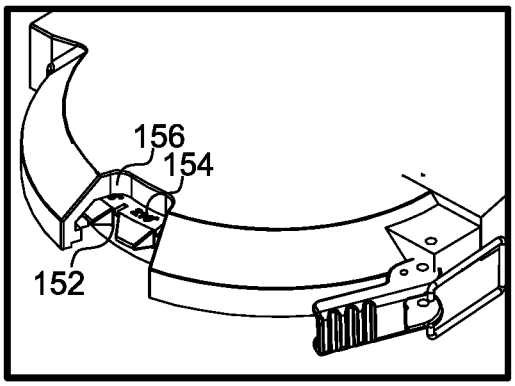
FIG. 7D is a detailed view diagram illustrating one embodiment of a mounting structure.

FIG. 7D illustrates how the first base portion 108 and the surface mounting structure 110 operate together. In an embodiment, the first base portion 108 may include viewing portal 156 for viewing the surface mounting structure 110. In an embodiment, the viewing portal 156 may be an opening in the first base portion 108. Alternatively, the viewing portal 156 may be a viewing window, or the like. In such an embodiment, a portion of the surface mounting structure 110, including one or more of the indicators 154, may be visible through the viewing portal 156 to facilitate adjustment to a specific position.

Figure 8:
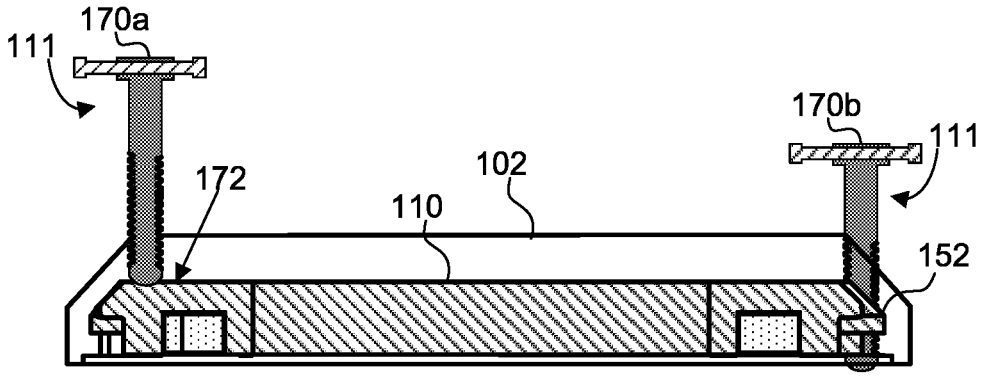
FIG. 8 is a cross-section view diagram illustrating one embodiment of a locking mechanism for a mounting structure.

FIG. 8 is a cross-section view diagram illustrating a further embodiment of the locking pin 111. In an embodiment, the locking pin 111 may include a T-handle screw 170*a-b*, as illustrated. In an embodiment, the T-handle screw 17*a-b* may be threaded into the first base portion 102 and/or the second base portion 104. In a first embodiment, the T-handle screw 170*a* may compress against a surface 172 of the surface mounting structure 110, thereby creating a compression force between the first base portion 102, the second base portion 104 and the surface mounting structure 110. Alternatively, the T-handle screw 170*b* may thread between adjustment points 152 and protrude, at least partially, from the bottom of the first base portion 102 and/or the second base portion 104.

Figure 9:
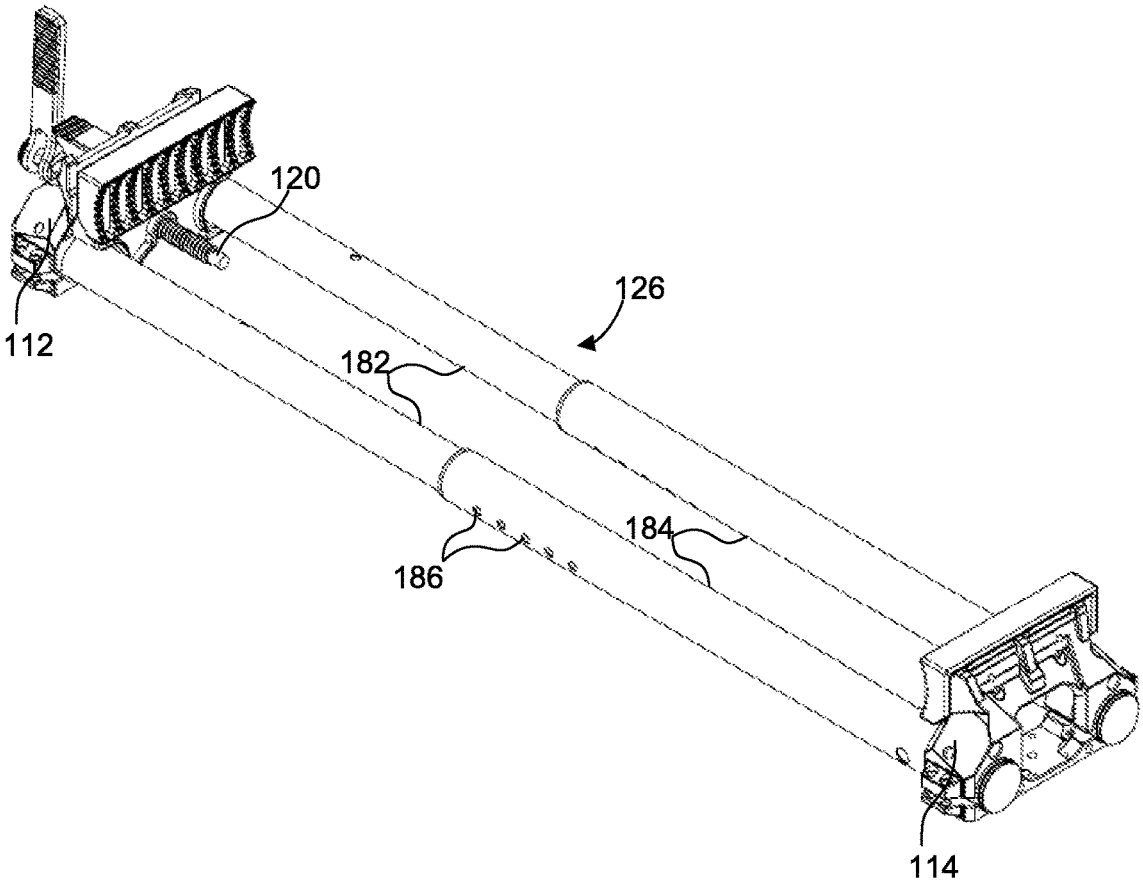
FIG. 9 is a perspective view diagram illustrating one embodiment of a telescoping guide rail.

FIG. 9 is a perspective view diagram illustrating one embodiment of guide rails 126. In the embodiment of FIG. 9, the guide rails 126 are telescoping rails. In such an embodiment, each guide rail 126 include a first portion 182 and a second portion 184. In an embodiment, the first portion 182 is configured to operate within an interior of the second portion 184. Thus, the first portion 182 may telescope, or extend from the second portion 184. Additionally, the guide rails 126 may include a setting mechanism, such as detents and detent receivers 186. In such an embodiment, macro-adjustment between first clamping jaw 112 and the second clamping jaw 114 may be achieved by telescoping the guide rails 126, while micro-adjustment of the relative position may be performed by adjustment of the driving element 120. As illustrated here, the driving element 120 may be substantially shorter than the guide rails 126.

Figure 10:
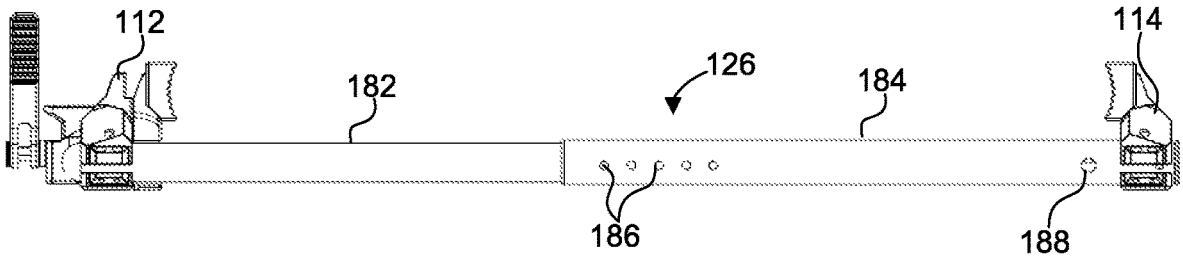
FIG. 10 is a side view diagram illustrating one embodiment of a telescoping guide rail.

FIG. 10 is a side view. In the embodiment of FIG. 10, an additional retention mechanism 188 is shown. The retention mechanism 188 may include a detent and detent receiver configured to retain the first portion 182 in a retracted position within the second portion 182.

In the above description, numerous details are set forth. It will be apparent, however, to one skilled in the art, that the present invention may be practiced without these specific details. In some instances, well-known structures and devices are shown in block diagram form, rather than in detail, in order to avoid obscuring the present invention.

It is to be understood that the above description is intended to be illustrative, and not restrictive. Many other embodiments will be apparent to those of skill in the art upon reading and understanding the above description. Although the present invention has been described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense. The scope of the invention should, therefore, be determined with reference to the appended claims, along with the full scope of equivalents to which such claims are entitled.

What is claimed is:

1. A vise comprising:

a clamping structure comprising:

a first clamping jaw;

a second clamping jaw positioned relative to the first clamping jaw; and a quick adjust jaw guide to maintain the first clamping jaw relative to the second clamping jaw; and an adjustable base configured to mount the clamping structure to a work surface, the adjustable base comprising:

a surface mounting structure configured to mount to a work surface, the surface mounting structure comprising positional adjustments to facilitate a positional adjustment of the vise relative to the work surface;

a vise mounting structure to interface with the surface mounting structure to secure the vise relative to the work surface, wherein the vise mounting structure engages with the positional adjustments of the surface mounting structure to facilitate adjustment of the position of the vise relative to the work surface; and an adjustment structure to facilitate rapid adjustment of the vise mounting structure relative to the surface mounting structure and to facilitate detachment of the vise mounting structure from the surface mounting structure.

2. The vise of claim 1, further comprising a driving element to apply a force to move the first clamping jaw relative to the second clamping jaw, wherein the driving element comprises a release structure to release the applied force to facilitate rapid adjustment of the first clamping jaw relative to the second clamping jaw.

3. The vise of claim 2, further comprising a force structure coupled to the driving element to facilitate a user application of force to the driving element.

4. The vise of claim 3, wherein the force structure comprises a ratcheting mechanism to move the first clamping jaw relative to the second clamping jaw.

5. The vise of claim 1, wherein the quick adjust jaw guide comprises at least one guide rail to maintain an alignment between the first clamping jaw and the second clamping jaw.

6. The vise of claim 5, wherein the at least one guide rail comprises a telescoping guide rail.

7. The vise of claim 1, wherein at least one of the first clamping jaw and the second clamping jaw is configured to receive a jaw pad.

8. The vise of claim 1, wherein the positional adjustments comprises slots disposed along an outer circumferential surface of the surface mounting structure.

9. The vise of claim 8, wherein the vise mounting structure comprises a first base portion and a second base portion connected to the first base portion via a hinge, the first base portion and the second base portion selectively engaging with the positional adjustments of the surface mounting structure.

10. The vise of claim 9, wherein the adjustment structure comprises a base closure which when released allows the first base portion and the second base portion to separate facilitating the rapid adjustment of the vise mounting structure relative to the surface mounting structure and the detachment of the vise mounting structure from the surface mounting structure.

11. The vise of claim 9, wherein the surface mounting structure further comprises indicators to communicate a relative position of the vise to the surface mounting structure.

12. The vise of claim 11, wherein the first base portion comprises a viewing portal through which one or more of the indicators is viewable.

13. A vise comprising:

a clamping structure comprising:

a first clamping jaw;

a second clamping jaw positioned relative to the first clamping jaw; and a quick adjust jaw guide to maintain the first clamping jaw relative to the second clamping jaw, wherein the quick adjust jaw guide comprises:

a driving element to apply a force to move the first clamping jaw relative to the second clamping jaw, wherein the driving element comprises a release structure to release the applied force to facilitate rapid adjustment of the first clamping jaw relative to the second clamping jaw; and an adjustable base configured to mount the clamping structure to a work surface, the adjustable base comprising:

a surface mounting structure configured to mount to a work surface, the surface mounting structure comprising circumferential positional adjustments to facilitate a positional adjustment of the vise relative to the work surface;

a vise mounting structure to interface with the surface mounting structure to secure the vise relative to the work surface, wherein the vise mounting structure comprises a first base portion and a second base portion connected to the first base portion via a hinge, the first base portion and the second base portion selectively engaging with the positional adjustments of the surface mounting structure to facilitate adjustment of the position of the vise relative to the work surface; and an adjustment structure comprising a base closure which when released allows the first base portion and the second base portion to separate facilitating rapid adjustment of the vise mounting structure relative to the surface mounting structure and facilitating detachment of the vise mounting structure from the surface mounting structure.

14. The vise of claim 13, wherein the surface mounting structure further comprises indicators to communicate a relative position of the vise to the surface mounting structure.

15. The vise of claim 14, wherein the first base portion comprises a viewing portal through which one or more of the indicators is viewable.

16. The vise of claim 13, wherein the circumferential positional adjustments comprise slots disposed about a circumference of the surface mounting structure.

17. The vise of claim 13, further comprising a force structure coupled to the driving element to facilitate a user application of force to the driving element, wherein the force structure comprises a ratcheting mechanism to move the first clamping jaw relative to the second clamping jaw.

18. The vise of claim 13, wherein the quick adjust jaw guide comprises at least one guide rail to maintain an alignment between the first clamping jaw and the second clamping jaw.

19. The vise of claim 18, wherein the at least one guide rail comprises a telescoping guide rail.

20. The vise of claim 13, wherein at least one of the first clamping jaw and the second clamping jaw is configured to receive a jaw pad.

21. The vise of claim 13, wherein the base closure comprises a latch and a handle configured to operate the latch.

22. The vice of claim 21, wherein the second base portion comprises a notch to receive the latch, the handle comprises a chamfered surface, and the base closure is configured to lock the first base portion and the second base portion by moving and engaging the latch with the notch and moving the chamfered surface of the handle into engagement with an outer surface of the first base portion.

* * * * *